US008429766B2

(12) United States Patent
Halfaker

(10) Patent No.: US 8,429,766 B2
(45) Date of Patent: Apr. 30, 2013

(54) HELMET WITH EMBEDDED SOUND SUPPRESSION EAR CUPS

(76) Inventor: Alvin J. Halfaker, Grand Rapids, MN (US)

( * ) Notice: Subject to any disclaimer, the term of this patent is extended or adjusted under 35 U.S.C. 154(b) by 0 days.

(21) Appl. No.: 13/455,492

(22) Filed: Apr. 25, 2012

(65) Prior Publication Data

US 2013/0061376 A1 Mar. 14, 2013

Related U.S. Application Data

(60) Provisional application No. 61/573,650, filed on Sep. 9, 2011.

(51) Int. Cl.
*A42B 1/06* (2006.01)

(52) U.S. Cl.
USPC ..... 2/209; 2/DIG. 3; 2/410

(58) Field of Classification Search ..... 2/414, 423, 2/209, 6.1, 422, 6.6, 410, 411, 424, 425, 2/208; 181/129, 137; 381/309, 310, 371, 381/376, 372
See application file for complete search history.

(56) References Cited

U.S. PATENT DOCUMENTS

| | | | | |
|---|---|---|---|---|
| 3,091,771 | A | 6/1963 | Bixby | |
| 3,621,488 | A | 11/1971 | Gales | |
| 3,943,572 | A | 3/1976 | Aileo | |
| 4,700,410 | A | 10/1987 | Westgate | |
| 5,020,163 | A * | 6/1991 | Aileo et al. | 2/209 |
| 5,101,517 | A | 4/1992 | Douglas | |
| 5,148,887 | A | 9/1992 | Murphy | |
| 5,241,971 | A | 9/1993 | Lundin | |
| 5,315,718 | A | 5/1994 | Barson et al. | |
| 5,632,048 | A | 5/1997 | Mortell et al. | |
| 6,154,890 | A | 12/2000 | Deopuria et al. | |
| 6,163,615 | A | 12/2000 | Callahan | |
| 6,289,522 | B1 | 9/2001 | Jones et al. | |
| 6,754,911 | B1 | 6/2004 | Howell | |
| 6,966,067 | B1 | 11/2005 | Lusk | |
| 7,024,013 | B1 | 4/2006 | Van Dam et al. | |
| 7,243,378 | B2 | 7/2007 | Desarmaux et al. | |
| 2007/0106169 | A1 | 5/2007 | Fadem | |
| 2012/0102629 | A1 * | 5/2012 | Lott et al. | 2/410 |

* cited by examiner

*Primary Examiner* — Danny Worrell
*Assistant Examiner* — Khaled Annis
(74) *Attorney, Agent, or Firm* — Thomas J. Nikolai; Nikolai & Mersereau, P.A.

(57) ABSTRACT

A sound attenuating device for standard helmets worn by riders of recreational vehicles is provided. The sound attenuating device includes low profile ear cups and compressible members mounted between the shell of the helmet and ear cups. The compressible members permit the ear cups to be moved away from the rider's face when doffing or donning the helmet and otherwise push the ear cups against the rider's face forming a tight seal between the rider's face and the ear cups around each ear. The means for attaching the compressible members to the helmet shell are non-penetrating so as to maintain the structural integrity and sound suppression characteristics of the shell.

7 Claims, 6 Drawing Sheets

Fig. 1
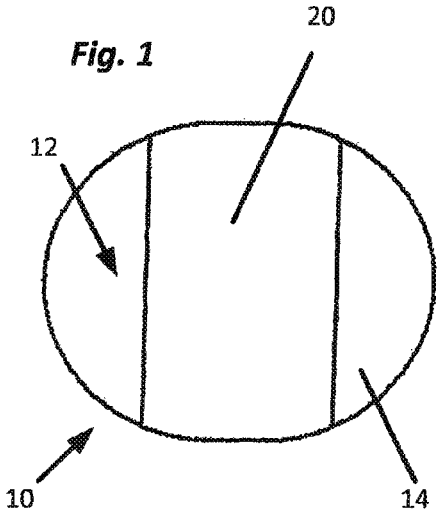
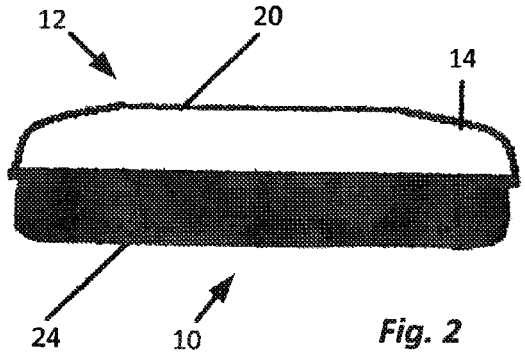
Fig. 2
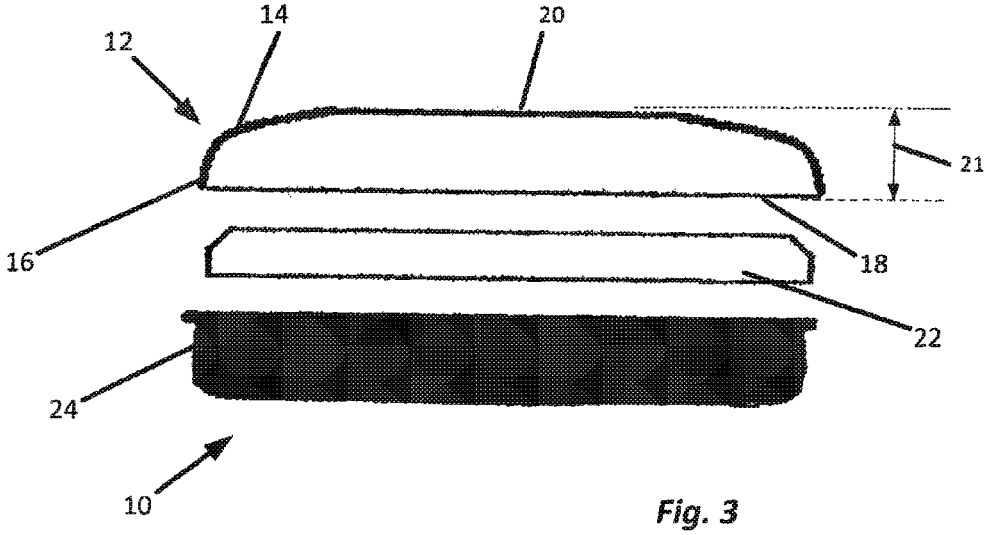
Fig. 3

HELMET WITH EMBEDDED SOUND SUPPRESSION EAR CUPS

CROSS REFERENCE TO RELATED APPLICATION

This application is a non-provisional application for Application No. 61/573,650, filed Sep. 9, 2011 and claims priority from that application which is also deemed incorporated by reference in its entirety in this application.

STATEMENT REGARDING FEDERALLY SPONSORED RESEARCH OR DEVELOPMENT

Not applicable.

BACKGROUND OF THE INVENTION

I. Field of the Invention

The present invention relates to concussion-resistant helmets worn by the riders of recreational vehicles such as motorcycles, dirt bikes, ATVs, snowmobiles power boats and the like. More specifically, the present invention relates to improving sound suppression for such helmets.

II. Related Art

Millions of people throughout the world participate in and enjoy recreational motor sports such as motorcycling, snowmobiling and power boating. However, at the end of a long day on the road, trail or water a rider of a recreational vehicle used in such sports will experience fatigue, a ringing sensation in his or her ears, and a loss of hearing that can last for days or even become permanent. This is due in part to the sounds generated by the engine of such a vehicle and the rider's close proximity to the engine for an extended period of time. Another significant contributing factor is wind noise produced around the rider's head while the rider is in motion.

By way of example, when a motorcycle rider is stopped at a stop light of a busy intersection with a standard helmet on and the visor close the rider experiences sound levels of 80 to 90 decibels. When the motorcycle is in motion and traveling at speeds between 35 miles per hour and 65 miles per hour, wind noise in such a helmet is the range of 110 to 116 decibels or even higher. At these exposure levels, the exposure time should be limited to no more than fifteen minutes a day to prevent hearing loss. The story is the same for snowmobile riders. Snowmobiles generate sound at about 105 decibels and the same wind noise will be encountered at the same speeds irrespective of the vehicle being ridden. Riders who do not wear a helmet at all (or wear skull caps or half shell models as opposed to a standard full coverage helmet) experience ten times more wind noise.

Many states place no restrictions on the noise generated by motorcycles, snowmobiles and other recreational vehicles. Those states that have adopted statutes or regulations placing restrictions on the noise generated by such vehicles have done so for the benefit of pedestrians and other bystanders rather than to protect the hearing of riders. For example, Michigan has adopted a sound restriction related to motorcycles of 86 decibels, but the measurement is taken 50 feet from the motorcycle when the motorcycle is traveling at more than 35 miles per hour. The sound level at the motorcycle itself and experienced by the rider is much higher due to proximity to the motorcycle. Also, the pedestrian's exposure to the noise generated by a particular motorcycle is often very brief. Riders are often exposed to such noise for hours at a time. New Hampshire's regulation does measure noise 20 inches from the exhaust pipe, but sets the threshold at 105 decibels. At this decibel level, exposure should be limited to one hour a day. No state has adopted a regulation that takes into account wind noise.

In fact, several states have adopted regulations antithetical to the protection of riders from hearing loss. Use of a custom set of ear plugs is a well-known and effective way to suppress sound. Several states have made it illegal to operate a motor vehicle such as a motorcycle while wearing ear plugs in both ears. These regulations make no sense. Why protect one ear from hearing loss, but not the other? Also, at highway speeds wind noise will drown out any other noise that the rider might hear eliminating any safety benefit derived from such a regulation.

As noted above, wearing a standard motorcycle or snowmobile helmet will attenuate noise to a significant degree, but no enough to prevent fatigue, or temporary or permanent hearing loss. The fact that helmet manufacturers have not addressed hearing loss issues suggests other overriding factors exist including comfort, fashion, and the current regulatory framework. There certainly are other techniques which could be employed when designing helmets to reduce vehicle and wind noise. However, none heretofore known are both legal in all jurisdictions and widely acceptable to consumers.

Pilots and others working in close proximity to jet aircraft are exposed to even higher and more damaging sound levels, levels in excess of 140 decibels. Sound at this level not only can result in hearing loss but also significant pain. Various ear muffs have been employed to protect the hearing of those working in close proximity to jet aircraft. Likewise, various helmets have been employed having built-in ear muffs.

For example, U.S. Pat. No. 3,091,771 to Bixby discloses an aviator's helmet having ear cups for receiving and fitting around the ears of the aviator. Wire springs are used to attach the ear cups to the shell of the helmet. Cables with pull tabs extend through the shell of the helmet so the cups can be retracted from the ears when the helmet is doffed. The arrangement shown in Bixby offers several disadvantages. First, mounting of the springs and cables requires penetration of the shell of the helmet. Second, sound generated by movement of these parts will be transmitted to the ear cups. Third, donning and doffing the helmet becomes more difficult because the wearer is required to pull on the pull tabs while doing so to retract the ear cups.

U.S. Pat. No. 3,943,572 to Aileo and U.S. Pat. No. 4,700,410 to Westgate attempt to overcome the problems with the Bixby design by eliminating the springs, cables and pull tabs. The ear cups of the designs of the Aileo and Westgate patents are instead mounted on straps adjacent the wearer's ears. Aileo shows the ear cups mounted on the inside of the straps and foam cushioning pads mounted on the outside of the straps. The foam cushioning pads keep the ear cups from contacting the helmet shell. However, the pads will rub against the shell and transmit sound through the cup caused by such rubbing. In Westgate, the foam pads are replaced with an inflatable bladder attached to the shell. However, the shell will rub against the bladder causing sound generated by such rubbing to be transmitted to the wearer's ears. Also, both Westgate and Aileo incorporate straps to support the cups. Helmets without such straps, such as standard motorcycle and snowmobile helmets, cannot easily be retrofitted to confoLlu to what is shown in Aileo and Westgate.

Still another problem with the Westgate and Aileo systems is the space required to mount ear cups as shown. This is why the shells of the helmets shown in Westgate and U.S. Pat. No. 6,154,890 to Deopuria et al have pronounced outwardly projecting ear domes. While helmets used by aviators typically have such outwardly projecting ear domes, helmets used by motorcycle and snowmobile riders typically have shells with smooth, uninterrupted contours and without outwardly projecting ear domes. These helmets are designed to have a snug fit and a smooth exterior because it has heretofore been believed that these features provide the best noise attenuation value. Also, and from a fashion standpoint, snowmobilers and motorcyclists will not find helmets with protruding ear domes to be acceptable.

Therefore, it is desirable to provide an improved method and apparatus for protecting the hearing of the riders of recreational vehicles such as motorcycles, ATVs and snowmobiles and to accommodate such an apparatus within existing helmets used by such riders or in new helmets which would be acceptable from a comfort, safety and fashion standpoint.

SUMMARY OF THE INVENTION

The invention overcomes the above-noted disadvantages and other deficiencies of the prior art by providing helmets for recreational vehicle riders and kits and methods for retrofitting preexisting helmets improve the sound suppression characteristics of the helmets. Such helmets include a hard exterior shell having a generally smooth uninterrupted contour without any outwardly projecting ear domes over the ears of the rider. Concussion padding is disposed within the hard exterior shell conforming substantially to the shape of the shell. First and second apertures are disposed in the padding in the areas in which the shell covers the rider's ears when the helmet is placed on the head of the rider. An inner liner is disposed within the hard exterior shell and cooperating with the shell to encapsulate the padding. First and second ear cups are provided. Each ear cup comprises a wall having a back portion, a rim portion, and a concave front portion, an acoustical noise-reducing member positioned within the concave front portion, and a comfort pad covering the rim portion. First and second compressible members are also provided. First and second non-shell penetrating attachment members are provided for attaching the first compressible member directly to the shell within the first aperture and the second compressible member directly to the shell within the second aperture. Third and fourth attachment members are also provided. The third attachment member attaches the first ear cup directly to the first compressible member and the fourth attachment member attaches the second ear cup directly to the second compressible member. As such, the compressible members cooperate with the shell and the ear cups so that the ear cups surround the ears of the rider and seals are formed between the comfort pads and the rider's head to encapsulate and isolate the ears to attenuate sound.

In at least one embodiment, the compressible members are inflatable bladders. Fluid lines couple the bladders to a bulb pump which is squeezed to inject fluid, e.g., air, into the bladders. A relief valve is also provided which may be opened to deflate the bladders. In other embodiments, the compressible members comprise one or more foam pads. When a compressible member comprises a plurality of foam pads, the pads may be of differing thickness and densities.

The attachment members may be of varying types. An adhesive may be used to secure a compressible member directly to the shell and, in turn, directly to the ear cup. Alternatively, the attachment member may be double-backed tape (i.e., a tape having an adhesive on both sides) used to secure the compressible member directly to the shell and also directly to the ear cup. Likewise, Velcro may be used to directly secure the compressible member to the helmet shell and the ear cup to the compressible member. Such attachment members may be mixed such that, for example, an adhesive is used to directly attach the compressible member to the shell and Velcro is used to attach the ear cup to the compressible member. What is important is that the attachment members do not penetrate the shell so as to form openings that might weaken or interfere with the structural integrity of the shell. Such openings and any object protracting from the shell could also serve to increase wind noise.

The noise-reducing members may be any suitable acoustical structure that will fit within the concave portion of the ear cup such as an acoustical foam. The comfort pad may be in the form of exposed foam, covered foam or a membrane filled with a gel or liquid or any combination thereof. Alternative materials which provide the requisite seal and desired level of comfort may also be employed.

These and other advantageous attributes will become more apparent from the accompanying drawings and detailed description provided below.

BRIEF DESCRIPTION OF THE DRAWINGS

FIG. 1 is a top plan view of an ear cup made in accordance with the present invention.

FIG. 2 is a side view of the ear cup of FIG. 1.

FIG. 3 is an exploded view showing the assembly of the ear cup of FIG. 1.

DETAILED DESCRIPTION

The present invention is ideally suited for use with standard helmets, such as motorcycle helmets and snowmobile helmets worn by recreational vehicle riders. As illustrated in FIGS. 5-7 and 9, such helmets have hard exterior shells 1 formed to substantially enclose the head of the rider. The hard exterior shells 1 have a generally smooth, uninterrupted contour. More specifically, the shells of such helmets do not include outwardly projecting ear domes such as those employed in the construction of military helmets such as those worn by aviators and tank drivers.

Figure 6:
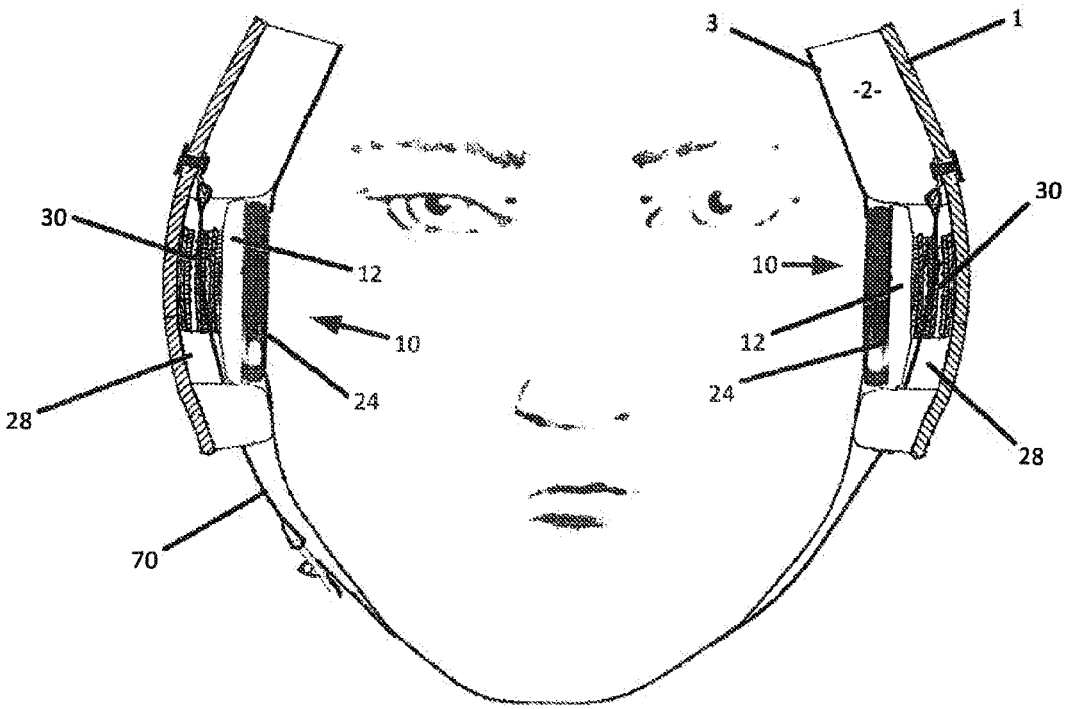
FIG. 6 is a cross-sectional view of a helmet showing two ear cup/compressible member assemblies of FIG. 4 mounted to the helmet.
Figure 9:
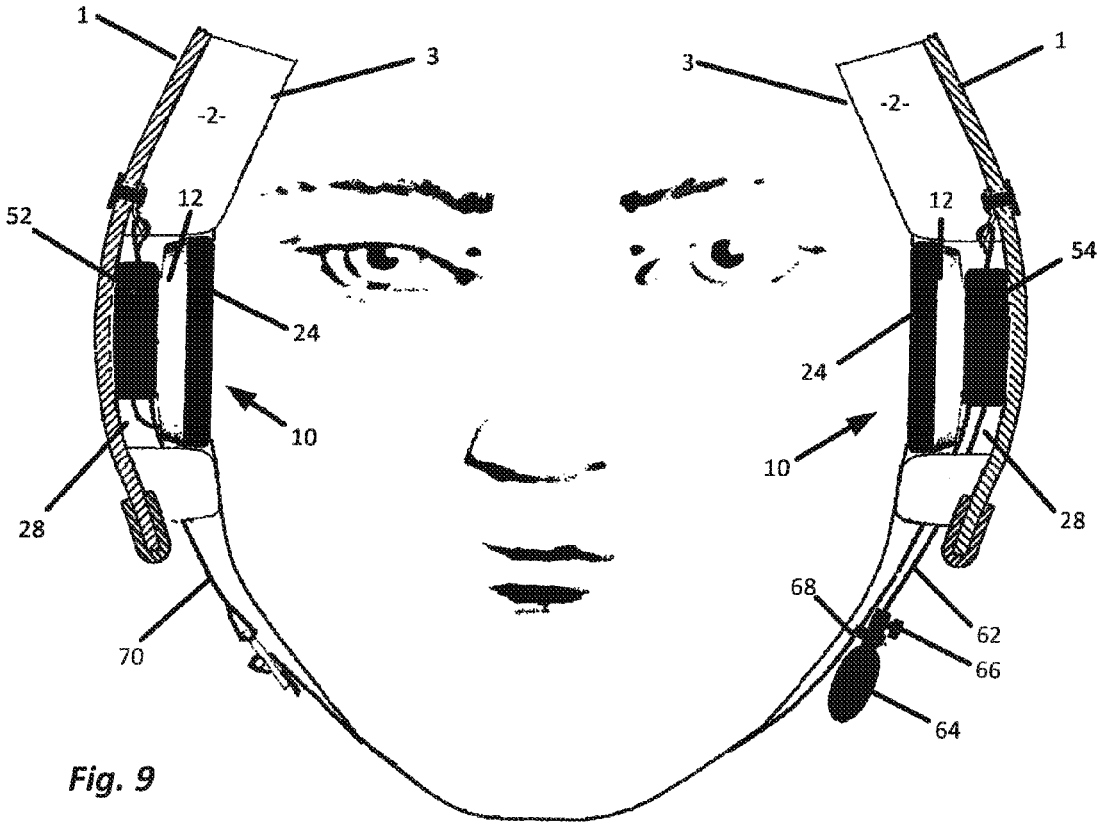
FIG. 9 is a cross-sectional view of a helmet showing the assembly of FIG. 8 mounted to the helmet.

Recreational vehicle helmets also almost universally include a concussion pad 2 disposed within the hard exterior shell 1. The concussion padding 2 has an outer surface that generally conforms to the shape of the shell 1. An inner liner 3 is often integrally formed over or attached to the inside surface of the concussion padding 2. The liner 3 cooperates with the shell 1 to encapsulate the concussion padding 2. As illustrated in FIGS. 6 and 9, the liner fits snuggly against the face of the wearer.

Given the arrangement of the shell 1, concussion padding 2 and the liner 3, the manner in which the helmet fits snuggly and the absence of ear domes, most recreational vehicle helmets rely exclusively on the acoustical characteristics of the shell 1, concussion padding 2 and liner 3 to limit sound reaching the ears of the rider. However, these features of the helmet provide insufficient hearing protection. Decibel levels reaching the ear are still sufficient to cause a ringing sensation and even permanent hearing loss, particularly if the rider is engaged in motorcycling, snowmobiling, or a related motor sport activity over an extended period of time. Some riders do employ ear plugs which fit into the canal of their ears, but these tend to be uncomfortable, illegal in some jurisdictions, and thus an ineffective solution. Traditional ear cups used in military helmets are simply too big to be employed given the space limitations imposed by the shell 1 and/or concussion padding 2.

The present invention solves these problems by providing a very slim, low profile ear cup 10, the design of which is shown in FIGS. 1-3. As shown, the ear cup includes a wall 12. The wall 12 has a back portion 14, a rim portion 16, and a concave front portion 18. The back portion 14 has a generally flat center section 20. The ear cup 10 also includes an acoustical noise-reducing member 22 positioned within the concave front portion 18. The acoustical noise-reducing member 22 may be any sound-absorbing or sound-cancelling device which will fit in the concave front portion 18. The use of acoustical foam as the noise-reducing member 22 is highly effective. The ear cup 10 also includes a comfort pad 24. The comfort pad 24 may also be a piece of foam, a piece of foam covered with some other material or a fluid-filled bladder. For example, a bladder filled with a gel may be employed as comfort pad 24. The comfort pad may be secured to the rim portion 16 in a variety of ways. For example, the comfort pad 24 may be glued to the rim portion 16 using a suitable adhesive. A simple compression fit between the pad 24 and rim portion 16 may also be employed. The arrangement shown in U.S. Pat. No. 5,241,971 to Lundin dated Sep. 7, 1993 may also be employed.

The above-described ear cup 10 is noteworthy because of its very low profile. Prior art ear cups typically comprise a shell generally having an outside depth dimension of 50 mm or more. The depth of the comfort pad used on such cups is often at least 15 mm making the total depth at least 65 mm. Since two such ear cups are required, the total dimension that must be accommodated is more than 130 mm or more than 5 inches. There simply is not enough room to accommodate such ear cups in a standard recreational vehicle helmet. Ear cup 10 is much slimmer. The outside depth dimension when measured as indicated at 21 in FIG. 3 is between 12 mm and 24 mm, thereby reducing the space required for the two ear cups 10 by 2% inches or more.

Figure 4:
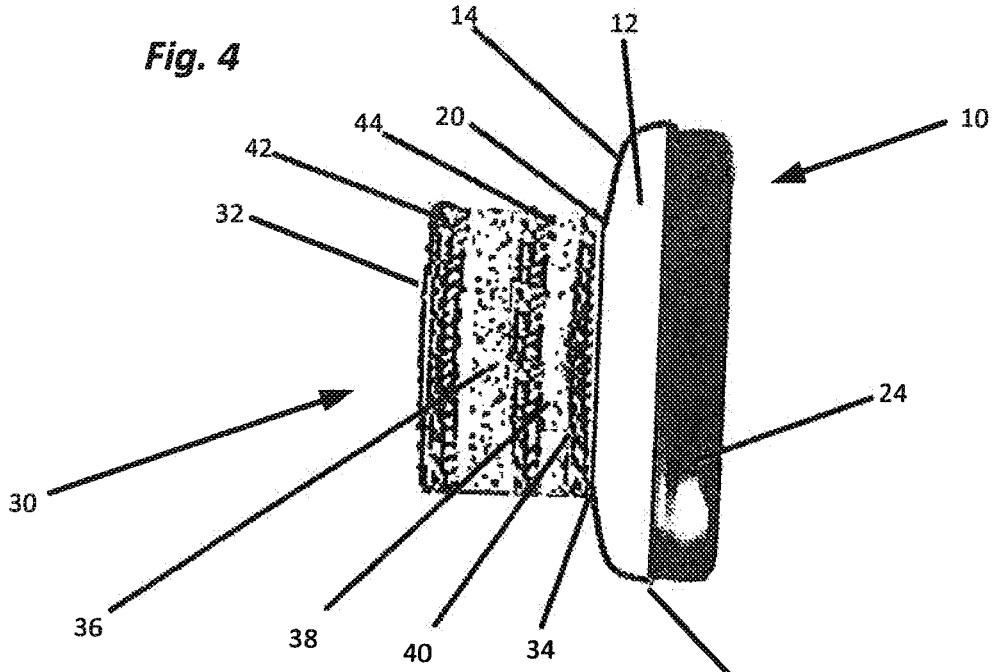
FIG. 4 is a side view of the ear cup of FIG. 1 attached to a compressible member.
Figure 5:
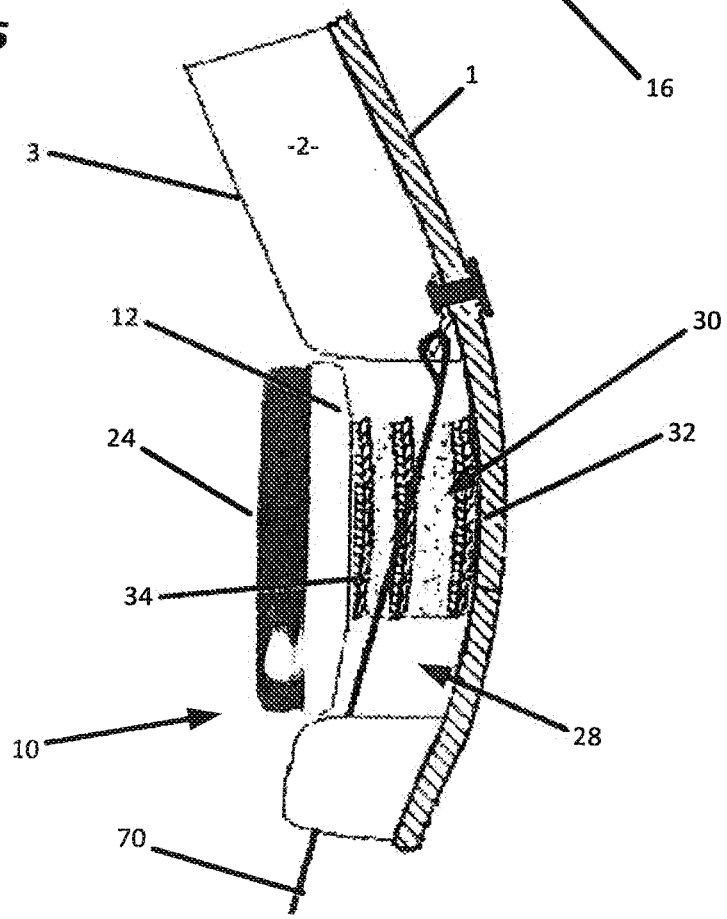
FIG. 5 is a cross-sectional view of a portion of a helmet showing the ear cup/compressible member assembly of FIG. 4 mounted to the interior of the shell of the helmet.

FIGS. 4-6 demonstrate one way in which the ear cups 10 may be mounted to the helmet. Specifically, and as best shown in FIGS. 5 and 6, portions of the concussion padding 2 are removed to form apertures 28 disposed in the padding 2 to expose the inside of shell 1 in the areas in which the shell 1 covered the rider's ears when placed on the rider's head. The apertures 28 are slightly larger than the cross-section of the ear cups 10 so that the ear cups 10 will fit into the apertures 28 as illustrated in FIGS. 5 and 6.

It is important that the ear cups 10 be resiliently mounted to the shell 1 rather than rigidly fixed to the shell 1. This is so the ear cups 10 will be able to move toward the shell 1 as the helmet is donned and doffed by the rider and so a tight seal is formed surrounding the rider's ears between the comfort pads 24 covering the rim portions 16 of the cups 10 and the rider's face. For this reason, first and second compressible members 30 are provided.

As shown in FIGS. 4-6, the compressible members 30 are positioned within the apertures 28 and each have a first end 32 coupled to the inner surface of the shell 1 of the helmet and a second end 34 coupled to the center section 20 of the back portion 14 of the wall 12 of an ear cup 10. The compressible member itself has at least one resilient foam pad. Two such foam pads 36 and 38 are shown in FIGS. 4-6. The foam used to foam pads 36 and 38 may be of the same or different densities and may have the same or different resilient properties. Pad 36, as shown, is thicker than pad 38. The thickness of the pad or pads should be selected so that the relaxed state of the compressible member acts to position the ear cups generally as shown in FIG. 5 such that the wall 12 is substantially within the aperture 28 and the comfort pad 24 projected toward the interior of the helmet from the aperture 28. When the rider dons or doffs the helmet, the compressible members 30 permit the ear cups 10 to be further retracted into the aperture as illustrated by comparing FIGS. 5 and 6. Most importantly, the resiliency of the compressible members 30 forces the comfort pads against the face around the ears to form a tight seal.

Various attachment members may be employed to secure pads 36 and 38 together, to secure the compressible member to the shell and to secure the compressible member to the center section of the back of the wall of the ear muff. Hook and loop attachment members 40, 42, and 44 such as those offered under the trade name, Velcro are shown in FIGS. 4-6. Double-backed tape, glues or other attachment mechanisms which similarly do not penetrate the shell could also be employed without deviating from the invention. One advantage derived from the use of Velcro is that the orientation of the parts can be adjusted to provide maximum noise suppression and comfort for the rider. In any case, the attachment members 42 used to attach compressible members 30 within the apertures 28 to the interior of the shell 1 of the helmet should not penetrate the shell 1. Any penetration of the shell 1 could serve to degrade the structural integrity of the shell 1 which must be maintained should the helmet come into contact with another object as a result of an accident. Any such penetration or any object projecting from any such penetration could increase wind noise. Likewise, the attachment members 40 used to attach the ear cups 10 to the compression member 30 should not penetrate the ear cup 10 to ensure maximum sound suppression. Any opening in or around the helmet or cup through which noise can reach the ear diminishes the efficacy of the subject invention.

Figure 8:
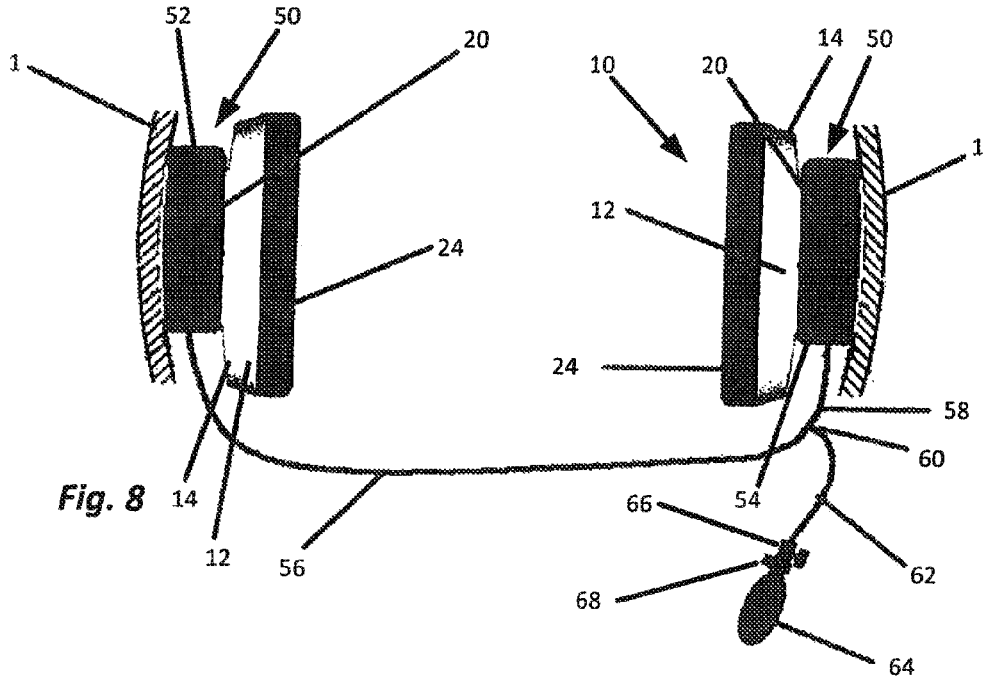
FIG. 8 shows a pair of ear cups mounted to a pair of bladders serving as compressible members together with inflation means for the bladders.
Figure 10:
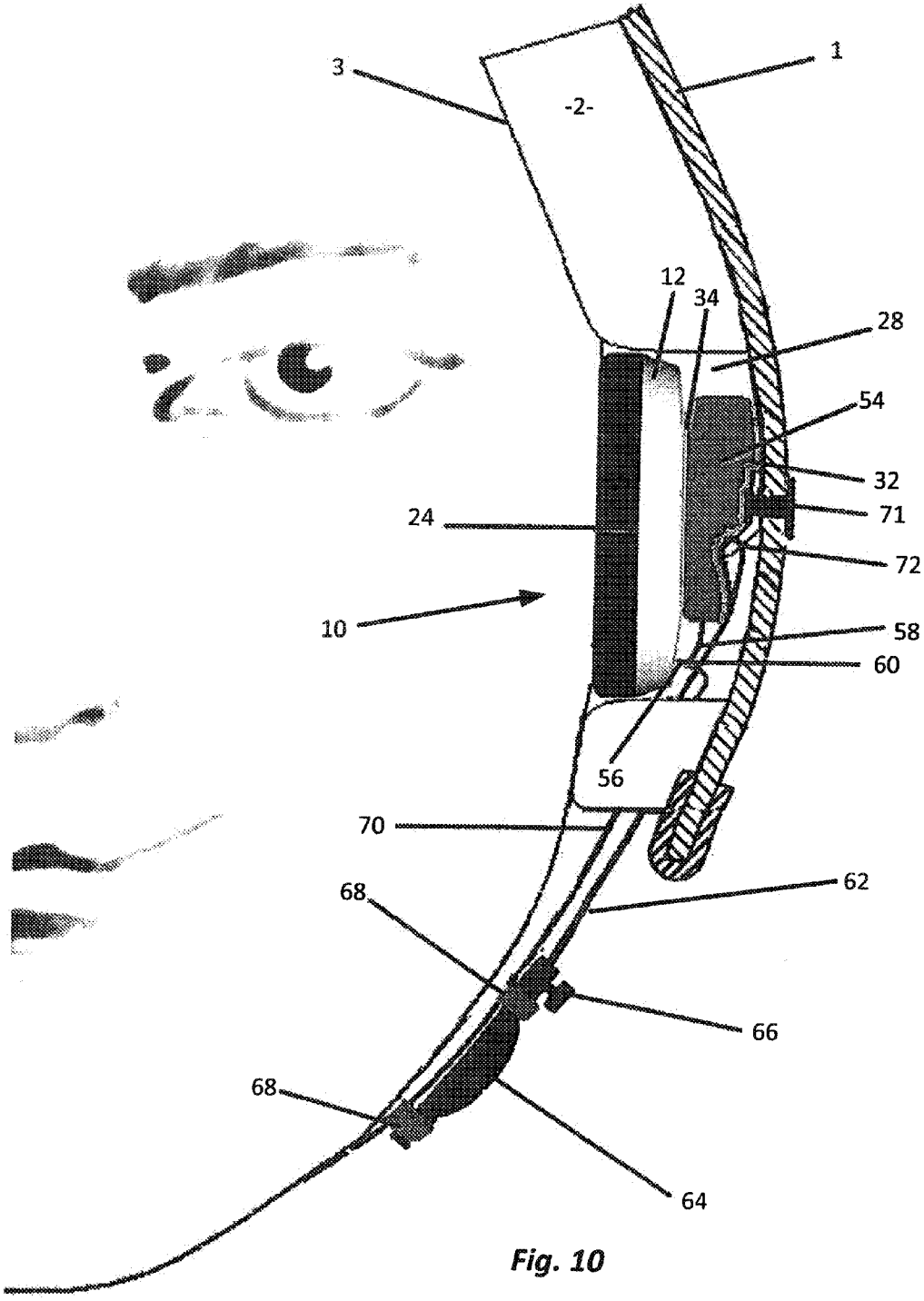
FIG. 10 is a partial cross-sectional view of the arrangement of FIG. 9, with a slimmer pump.

FIGS. 8 through 10 illustrate alternative embodiments. In the embodiments of FIGS. 8 through 10, the compressible members 30 comprising foam pads 36 and 38 are replaced with compression members 50 comprising inflatable bladders 52 and 54. The inflatable bladders 52 and 54 are positioned within apertures 28 formed in the concussion padding 2. One side of each bladder 52 and 54 is fixed to the inside surface of the shell 1. The other side of each bladder 52 and 54 is attached to the center section 20 of the back 14 of cup 12. The attachment members used to attach the bladders 52 and 54 to the helmet shell 1 and the ear cup 10 may be Velcro, glue, double-sided tape, snaps, or any other known means for making such attachments. Again, the attachment members should not penetrate the shell 1 since any such penetration could adversely affect the structural integrity and sound suppression characteristics of the shell 1. Any such attachment member should not penetrate the ear cup 10 because any such penetration could affect the sound suppression capabilities of the ear cup 10.

The embodiment shown in FIGS. 8 through 10 also includes means for inflating and deflating the bladders 52 and 54. Specifically, a first fluid line 56 is attached to bladder 52 and a second fluid line 58 is attached to bladder 54. The fluid lines 56 and 58 come together at a "T" 60 with a third fluid line 62. The third fluid line extends between the "T" and a bulb pump 64 like the bulb pump often used to inflate a sphygmomanometer used to check blood pressure. By manually squeezing the bulb pump 64, a fluid such as air is pumped through the fluid lines 62, 56 and 58 to simultaneously inflate the bladders 52 and 54. A relief valve 66 is also provided. Again, the relief valve 66 may be of the type used when constructing sphygmomanometers. A knob is turned in one direction to close the valve and trap the fluid in the bladders 52 and 54. The knob is turned in the opposite direction to open the valve 66 and deflate the bladders 52 and 54. Other valves having other actuators may be employed without deviating from the invention. As shown in FIG. 9, a clip 68 may also be provided in close proximity to the pump 64 and valve 66 to secure the assembly to the chin strap 70 of the helmet. Also, the fluid lines and "T" are, for the most part, hidden from view in FIG. 9 and when the helmet is worn because they are generally positioned between the shell 1 and the back of the rider's head.

FIG. 10 shows certain modifications to what is shown in FIGS. 8 and 9. Specifically, in FIG. 10, the rivet 71 and clip 72 for attaching the helmet strap 70 are positioned lower so they intersect the aperture 28 in the padding 2. When the helmet is so constructed, one side 34 of the bladder 54 is secured to the center section of the back portion of the wall 12. The other side 32 of the bladder 54 is secured at least in part to the shell 1 but may also have portions secured to the rivet 71, clip 72 and even portions of the strap 70. Making such a convention is most easily achieved using an adhesive glue. FIG. 10 also shows a bulb-type pump 64 which is slimmer than the bulb 64 shown in FIGS. 8 and 9. Also, bulb 64, as shown in FIG. 10, is provided with two elongate members at opposite ends so that a pair of clips 68 is provided to attach the pump 64 to strap 70.

The reader should appreciate that the improvements described above may be implemented at the time the helmet is manufactured. Helmets may also be retrofitted at some later point in time to provide the advantages of the present invention. To facilitate such retrofitting of a helmet, a kit may be provided. The kit includes first and second ear cups of the type described above with reference to FIGS. 1-3. The kit also includes first and second compressible members. These compressible members may comprise one or more foam pads like the compressible member 30 shown in FIGS. 4-6 or may comprise bladders such as the bladders 52 and 54 illustrated in FIGS. 8 and 9. When the kit includes such bladders, tubing a "T", a clip, a bulb pump and relief valve are also provided. The bladders and components used to inflate and deflate the bladders may be preassembled. The kit may or may not also include one or more tools which may be employed to form first and second apertures in the concussion padding of the helmet in the areas in which the shell covers the rider's ears when the helmet is placed on the head of the rider. In either case, the purchaser of the kit will be instructed to form such apertures while leaving the shell completely in tact.

The kit will also include sufficient material to form (a) first and second attachment members used to directly attach the first compressible member to the shell within the first aperture and the second compressible member to the shell within the second aperture; and (b) third and fourth attachment members attaching the first ear cup to the first compressible member and the second ear cup to the second compressible member. Such material may be a suitable length of Velcro, a suitable length of double-sided adhesive tape, a supply of glue, or the like. Again, the material provided should not require any penetration through the shell or ear cup to maintain the structural integrity and the sound suppression capabilities of the shell and ear cups.

The instructions provided will also advise the purchaser how to operate the pump or how to form the compressible members out of foam pads to permit donning and doffing of the helmet and to form a tight seal around the ears between the comfort pads of the ear cups and the rider's face.

Figure 11:
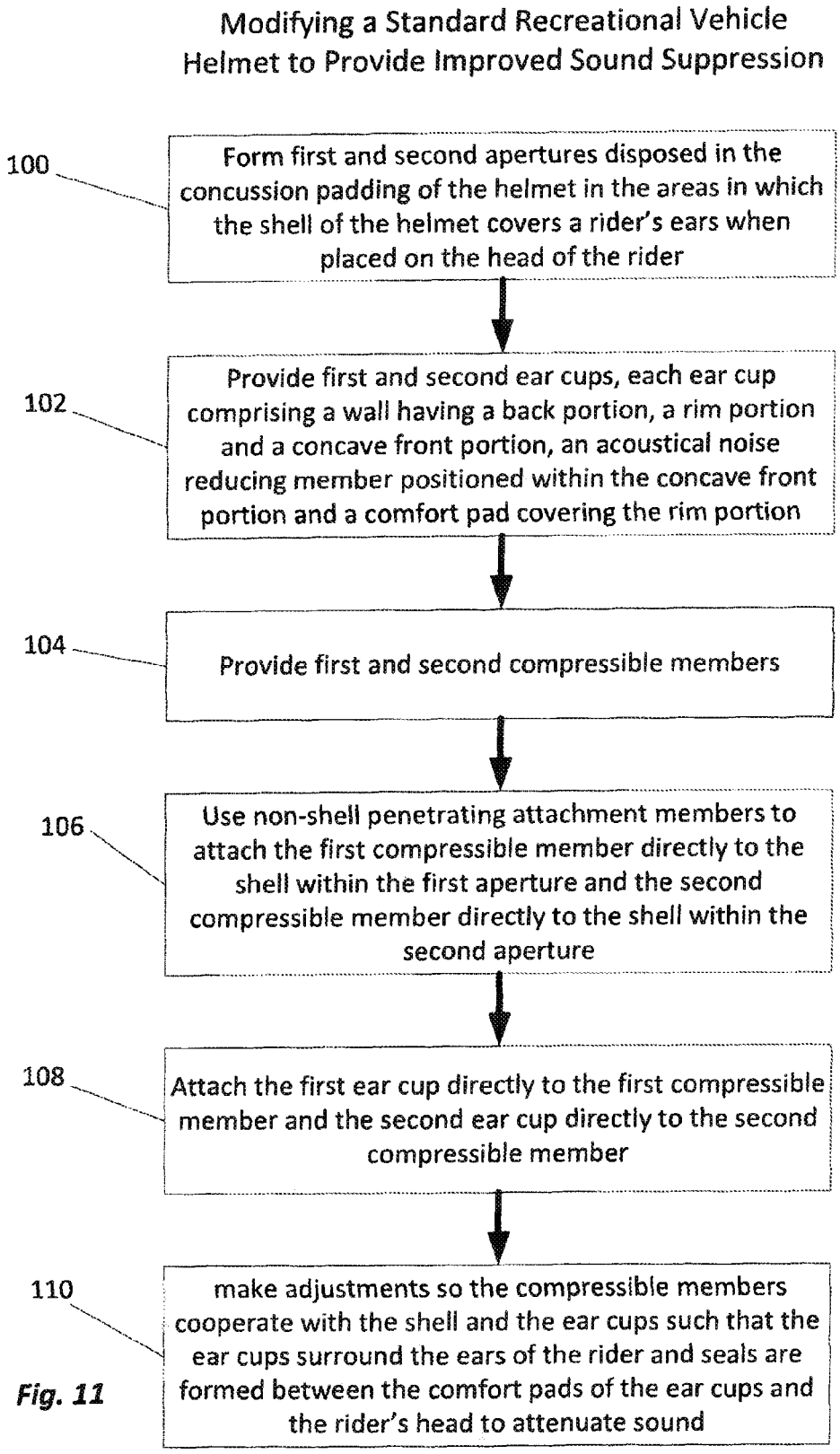
FIG. 11 is a flow chart describing a method for installing the apparatus shown in FIGS. 1-9 in a standard motorcycle or snowmobile helmet.

FIG. 11 not only describes the method of modifying a standard recreational vehicle helmet in accordance with the invention, but also provides an outline of the instructions that might be provided with such a kit.

Figure 7:
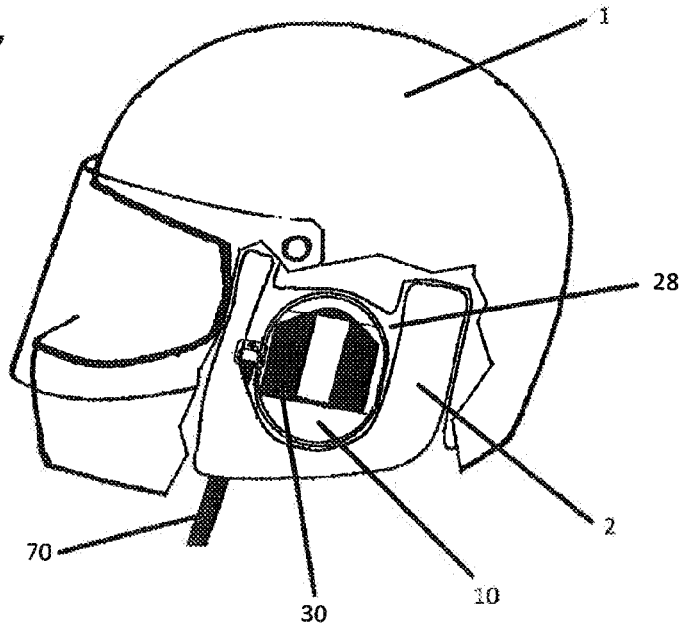
FIG. 7 is a side view of a helmet with a portion of the shell removed to expose an ear cup and a compressible member mounted to the shell.

As noted above, standard helmets used by riders of recreational vehicles such as snowmobiles, motorcycles, power boats, and ATVs have a hard exterior shell 1 and concussion padding 2. At step 100, apertures (such as apertures 28) are disposed in the concussion padding 2 of the helmet in the area in which the shell 1 of the helmet covers the rider's ears when the helmet is placed on the rider's head. These first and second apertures should have a large enough cross-section to later receive compression members such as compression member 30 as shown in FIG. 7 or compression member 50 as shown in FIG. 9 and to receive the ear cups 10 as shown in FIGS. 7 and 9.

At step 102, first and second ear cups 10 like those shown in FIGS. 1-3 and described above are provided. At step 104, first and second compressible members, either like those described with reference to FIG. 4 or like those described with reference to FIG. 8, are provided.

At step 106, the compressive members provided at step 104 are attached directly to the inner surface of the shell within the first and second apertures formed at step 100. These attachments are made using non-shell penetrating attachment members such as Velcro, a double-sided tape or an adhesive glue. This method of attachment ensures the structural integrity and sound suppression capabilities of the shell are maintained.

At step 108, the ear cups provided at step 102 are directly attached to the compressible members provided at step 104. Again, an adhesive glue, double-sided tape, or Velcro may be used to make this attachment. While FIG. 10 shows step 106 being performed before step 108, step 108 may be performed before step 106 without deviating from the invention. In fact, each of the steps may be performed in any logical order and the order identified in FIG. 10 (or the method claims) is not intended to be limiting unless specifically indicated.

At step 110, adjustments are made so the compressible members cooperate with the shell and ear cups such that the ear cups surround the ears of the rider and effective sound attenuating seals are formed between the comfort pads of the ear cups and the rider's head to attenuate sound. Such adjustments may be made when providing the compressible members. This is particularly contemplated when compressible members such as members 30 are employed. Such adjustments may be made when attaching the compressible members to the shell or the ear cups to the compressible members. This is particularly important when double-sided tape or adhesives are used as attachment members. Adjustments may be made later when Velcro is used as the attachment members because Velcro will permit later adjustment of the positions of compressible members relative to the shell and of the positions of the ear cups relative to the compressible members. When bladders such as 50 are used as the compressible members, adjustments may be made by increasing or decreasing the volume of fluid in the bladders.

When making such adjustments, one should consider whether the rider will be wearing one or more ear buds in addition to the helmet. Ear buds are often plugged into a music player or cellular telephone to enable a user to hear the music or the telephone conversation. Comfort pads of the type described above will seal around the wires attached to the ear buds when proper adjustments are made to the compressible members, for example, when the bladders 50 are inflated with the proper volume of fluid.

The present invention offers a number of advantages. Sound reaching the ears of the drivers or passengers of recreational vehicles such as motorcycles and snowmobiles is reduced to acceptable levels. Helmets manufactured or modified in accordance with the invention are comfortable to wear. Such helmets may be donned and doffed without unduly pulling or pushing on the outer structures of the ears. Unlike ear plugs which may not be used in many jurisdictions and, in any event cannot be used in conjunction with ear buds, the present invention may be used with or without ear buds as the rider sees fit.

The disclosed embodiments are, of course, illustrative of the invention, but are not intended to be limiting. The invention can be practiced in other ways and the embodiments most certainly may be implemented without departing from the spirit and scope of the invention. The invention is inclusive of any embodiment falling within the scope of the claims and all equivalents thereof.

What is claimed is:

1. A concussion resistant helmet for riders of recreational vehicles with improved sound suppression comprising:

a. a hard exterior shell formed to substantially enclose the head of the rider, said hard exterior shell having a generally smooth uninterrupted contour without any outwardly projecting ear domes over the ears of the rider;

b. concussion padding disposed within the hard exterior shell conforming substantially to the shape of the shell;

c. first and second apertures disposed in the padding in the areas in which the shell covers a rider's ears when placed on the head of the rider d. an inner liner disposed within the hard exterior shell and cooperating with the shell to encapsulate the padding;

e. first and second ear cups, each ear cup comprising a wall having a back portion, a rim portion and a concave front portion, an acoustical noise reducing member positioned within the concave front portion and a comfort pad covering the rim portion;

f. first and second inflatable bladders;

g. first and second non-shell penetrating attachment members attaching the first inflatable bladder directly to the hard exterior shell within the first aperture and the second inflatable bladder directly to the hard exterior shell within the second aperture;

h. third and fourth non-shell penetrating attachment members located between and attaching the first ear cup directly to the first inflatable bladder and the second ear cup directly to the second inflatable bladder wherein the inflatable bladders cooperate with the hard exterior shell and the ear cups so that the ear cups surround the ears of the rider and seals are formed between the comfort pads and the rider's head to attenuate sound; and i. (i) a bulbpump and valve for inflating and deflating the inflatable bladders., said pump and valve positioned exterior to the hard exterior shell and coupled to the inflatable bladders by tubing such that the pump, valve and tubing do not penetrate the hard exterior shell.

2. The concussion resistant helmet of claim 1 wherein the attachment members are selected from a group consisting of glue, double-backed tape, and hook and loop attachment members.

3. The concussion resistant helmet of claim 1 wherein the noise reducing members are acoustical foam pads.

4. A kit for improving the sound suppression capabilities of a concussion resistant helmet having a hard exterior shell formed to substantially enclose the head of the rider, said hard exterior shell having a generally smooth uninterrupted contour without any outwardly projecting ear domes over the ears of the rider, concussion padding disposed within the hard exterior shell conforming substantially to the shape of the shell, and an inner liner disposed within the hard exterior shell and cooperating with the hard exterior shell to encapsulate the padding, said helmet intended to be worn by riders of recreational vehicles, the kit comprising:

f. first and second ear cups, each ear cup comprising a wall having a back portion, a rim portion and a concave front portion, an acoustical noise reducing member positioned within the concave front portion and a comfort pad covering the rim portion;

g. first and second inflatable bladders;

h. first and second non-shell penetrating attachment members used to directly attach the first inflatable bladder to the hard exterior shell within a first aperture and the second inflatable bladder to the hard exterior shell within a second aperture, said first and second apertures formed in the padding of the helmet in the areas in which the hard exterior shell covers a rider's ears when the helmet placed on the head of the rider;

i. third and fourth attachment members positioned between and attaching the first ear cup to the first inflatable bladder and the second ear cup to the second inflatable bladder such that the inflatable bladders cooperate with the hard exterior shell and the ear cups so that the ear cups surround the ears of the rider and seals are formed between the comfort pads and the rider's head to attenuate sound; and j. a pump and valve for inflating and deflating the inflatable bladders, said pump and valve positioned exterior to the hard exterior shell and coupled to the inflatable bladders by tubing such that the pump, valve and tubing do not penetrate the hard exterior shell.

5. The kit of claim 4 further including a bulb pump and fluid lines joining the bladders to the bulb pump.

6. The kit of claim 4 wherein the attachment members are selected from a group consisting of glue, double-backed tape, and hook and loop type attachment members.

7. The concussion resistant helmet of claim 4 wherein the noise reducing members are acoustical foam pads.

* * * * *